United States Patent [19]

Crouse et al.

[11] Patent Number: 4,925,080

[45] Date of Patent: May 15, 1990

[54] SPREADER BAR APPARATUS

[75] Inventors: Jere W. Crouse, Beloit, Wis.; Stewart B. Olson, Lexington, Ky.

[73] Assignee: Beloit Corporation, Beloit, Wis.

[21] Appl. No.: 257,679

[22] Filed: Oct. 13, 1988

[51] Int. Cl.[5] ..... B65H 23/24

[52] U.S. Cl. ..... 226/196; 226/97

[58] Field of Search ..... 226/97, 196; 242/56.5

[56] References Cited

U.S. PATENT DOCUMENTS 4,176,775 12/1979 Brendemuehl ..... 226/97 X 4,824,002 4/1989 Ford et al. ..... 226/97 x

FOREIGN PATENT DOCUMENTS 2542659 7/1977 Fed. Rep. of Germany ..... 226/97

*Primary Examiner*—Donald Watkins

*Attorney, Agent, or Firm*—Dirk J. Veneman; Raymond W. Campbell; David J. Archer

[57] ABSTRACT

A spreader bar apparatus is disclosed for separating slit portions of a web. The apparatus includes a first spreader bar which extends in a cross-machine direction relative to the web. The first spreader bar is bowed relative to the slit portions such that the slit portions are separated axially relative to each other when the slit portions are guided around the first spreader bar. A second spreader bar is disposed downstream relative to the first bar and extends in a cross-machine direction relative to the web for guiding the separated slit portions. The second bar is bowed relative to the separated slit portions such that each of the slit portions disposed downstream relative to the second bar is disposed parallel to each other. A first and a second porous layer are connected to the first and second bars respectively such that when the bars are connected to a source of pressurized air, air flows through the bars and the porous layers towards the slit portions for generating respectively a first and second air cushion. The cushions reduce the frictional resistance between the moving slit portions and the bars. Additionally, the air cushions reduce the noise level caused by movement of the slit portions when the slit portions move relative to and are guided by the spreader bars.

9 Claims, 3 Drawing Sheets

PRIOR ART
Fig. 1
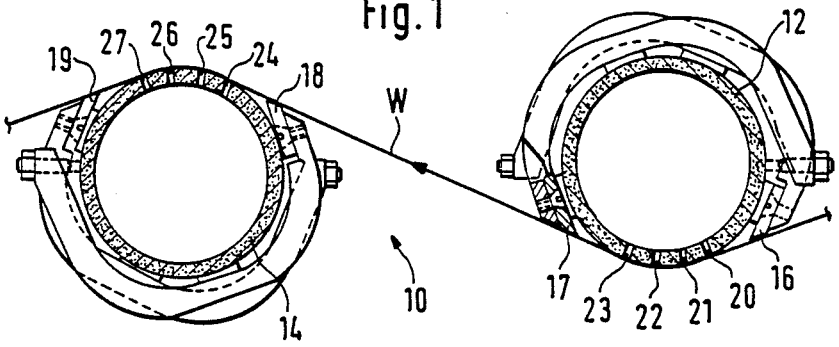
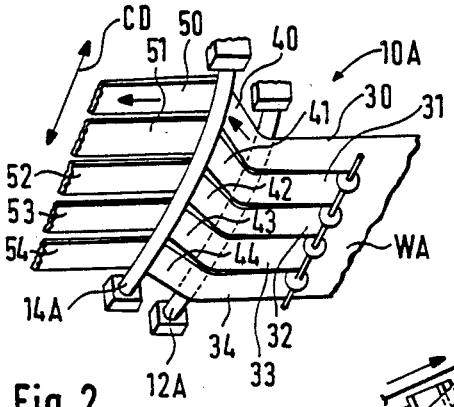
Fig. 2
Fig. 3
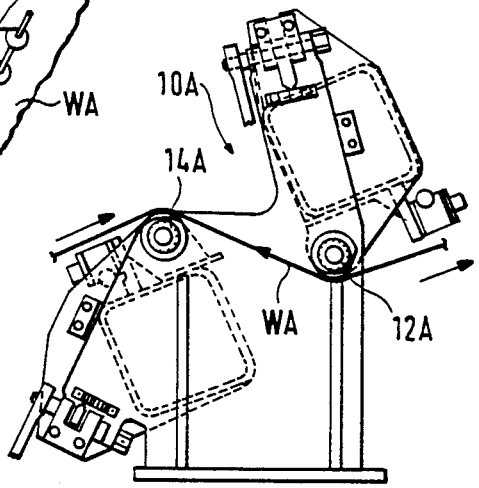

Fig. 6
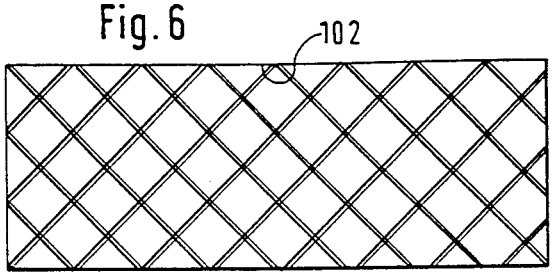
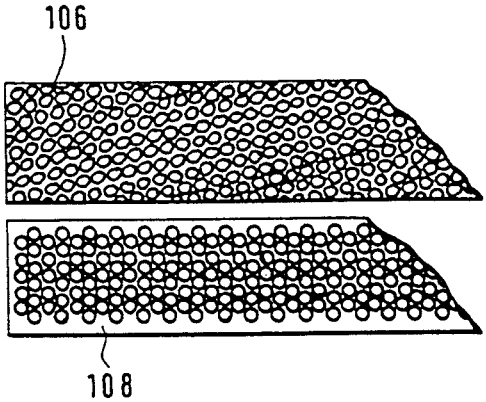
Fig. 7

SPREADER BAR APPARATUS

BACKGROUND OF THE INVENTION

1. FIELD OF THE INVENTION

This invention relates to a spreader bar apparatus for separating slit portions of a web. More particularly, this invention relates to a spreader bar apparatus which includes porous layers for reducing the noise level generated by movement of the web over the spreader bars.

2. Information Disclosure Statement

In the papermaking industry, a web of paper is formed from stock in a forming section. The formed web is then pressed for removing a substantial portion of the water from the web. Thereafter, the pressed web extends through a drying section for removing a further portion of water from the pressed web. Next, the dried web is guided through a calender for smoothing the surface of the dried web. Finally, the web is guided from the calender to a reeling apparatus where the web is wound onto a reel which has a length of 30 or more feet and a diameter of 5 or more feet.

Typically, the wound reel of paper is rewound in order to provide wound rolls having a length of between 1 to 5 feet.

In order to cut the large reel into more manageable rolls of paper, the web is rewound from the reel over a stationary spreader bar. Rotating slitting knives are disposed in spaced axial relationship along the cross-machine direction relative to the web between the reel being unwound and the spreader bar.

As the slit portions extend over and around a bowed spreader bar, the slit portions of the web separate axially relative to each other. Such separated slit portions are then guided around a further spreader bar which is bowed such that the separated slit portions are disposed parallel relative to each other.

The separated parallel slit portions are then rewound onto individual reels having a length corresponding to the spacing between adjacent slitters.

In view of the high speeds at which the web is guided around the spreader bars, a problem has existed in that considerable frictional resistance is generated between the spreader bars and the web as the web extends around the spreader bars.

Additionally and more importantly, the noise level caused by the movement of the slit portions moving relative to the spreader bars is extremely high and such noise level has sometimes caused health problems amongst operating personnel.

One attempt to reduce the noise level of spreader bars is disclosed in U.S. Pat. No. 4,300,714 to Dahl et al, issued Nov. 17, 1981. U.S. Pat. No. 4,300,714 discloses baffle bars attached to the curved bars in order to eliminate the Coanda effect of air tending to follow the curvature of the stationary cylinders of the spreader bars. However in the aforementioned arrangement, once the baffle bars were attached to the spreader bars, the ability to rotate the spreader bars in order to accommodate different grades of paper was virtually eliminated.

The present invention overcomes the aforementioned problem by the provision of porous layers secured to the spreader bars to replace the air supply holes used in the prior art arrangements. The air is supplied through the porous media to provide a uniform cushion of air to efficiently float the paper web over the curvature of the bars without being influenced by the Coanda effect.

Therefore, it is a primary object of the present invention to provide a spreader bar apparatus that overcomes the aforementioned inadequacies of the prior art arrangements and that provides a considerable contribution to the art of rewinding paper webs.

SUMMARY OF THE INVENTION

The present invention relates to a spreader bar apparatus and method for separating slit portions of a web. The apparatus includes a first spreader bar which extends in a cross-machine direction relative to the web. The first bar is bowed relative to the slit portions such that the slit portions are separated axially relative to each other when the slit portions are guided around the first spreader bar. A second spreader bar is disposed downstream relative to the first bar and extends in a cross-machine direction relative to the web. The second bar guides the separated slit portions and is bowed relative to the separated slit portions such that each of the slit portions disposed downstream relative to the second bar is disposed parallel to each other. A first and second porous layer are connected to the first and second bars respectively such that when the bars are connected to a source of pressurized air, air flows through the bars and the porous layers towards the slit portions for generating respectively a first and a second air cushion. The air cushions reduce the frictional resistance between the moving slit portions and the bars. Additionally, the air cushions reduce the noise level caused by movement of the slit portions when the slit portions move relative to and are guided by the spreader bars.

In a more specific embodiment of the present invention, the first spreader bar includes a first tube which extends in a cross-machine direction relative to the web. The first tube has an inner and an outer surface with the inner surface defining a first conduit which extends in the cross-machine direction. The first conduit is connected to a source of pressurized air. The first tube also defines an elongate slot which extends in the cross-machine direction and also extends from the inner to the outer surface.

The slot has a width in a machine direction which is greater than the wrap angle of the slit portions relative to the first porous layer.

The first porous layer is secured to the first tube such that the first porous layer is disposed between the slit portions and the slot so that when the first conduit is connected to the source of pressurized air, air flows through the first conduit and the slot and through the first porous layer for generating the first air cushion between the first porous layer and the slit portions.

The second spreader bar also includes a second tube which extends in the cross-machine direction relative to the web. The second tube has an inner and an outer face with the inner face defining a second conduit which extends in the cross-machine direction. The second conduit is connected to the source of pressurized air and the second tube defines an elongate slit which extends in the cross-machine direction and extends from the inner to the outer face.

The slit has a width in a machine direction which is greater than the wrap angle of the slit portions relative to the second porous layer.

The second porous layer is secured to the second tube such that the second porous layer is disposed between the slit portions and the elongate slit so that when the second conduit is connected to the source of pressurized air, air flows through the second conduit and the slit and through the second porous layer for generating the second air cushion between the second porous layer and the slit portion.

In one embodiment of the present invention, the first and the second porous layers are tubular and extend around the outer surface and face respectively of the first and second tubes.

In a preferred embodiment of the present invention, the first and second porous layers extend around a first and second portion respectively of the first and second bars respectively so that the first layer covers the slot and the second layer covers the slit.

Furthermore, the slot and the slit house a first and second honeycomb support respectively. The supports support respectively the first and second porous layers.

In a variation of the preferred embodiment, the slot and the slit house respectively a first and second prop. The props each define a plurality of holes and support respectively the first and second layers.

In a preferred embodiment of the present invention, the porous layers are fabricated from porous plastic having a porosity within the range 20 to 100 microns.

The width of the slot and the slit respectively are such that each width defines an arc of at least 63°.

In a preferred embodiment of the present invention, the first and the second tubes are fabricated from a phenolic resin.

Many modifications and variations of the present invention will be readily apparent to those skilled in the art and although the present invention is particularly directed to the aforementioned spreader bars, it will be apparent that the present invention has equal applicability to stationary rider rolls, stationary paper rolls and guide rolls for the dry end of a paper machine. Additionally the present invention is applicable to stationary bowed rolls and stationary calender fly rolls.

In each of the aforementioned applications, the provision of porous layers greatly reduces the noise level in comparison with prior art arrangements.

The aforementioned many modifications and variations of the present invention will be apparent from the detailed description contained hereinafter and from the annexed drawings. However, such modifications and variations fall within the spirit and scope of the present invention as defined by the appended claims.

BRIEF DESCRIPTION OF THE DRAWINGS

FIG. 1 is a sectional view of a prior art spreader bar apparatus showing a first and second spreader bar with baffle bars attached thereto;

FIG. 2 is a perspective view taken from beneath the spreader bar apparatus according to the present invention;

FIG. 3 is a side-elevational view of the spreader bar apparatus shown in FIG. 2;

FIG. 6 is a plan view of a honeycomb support for the porous layer according to one embodiment of the present invention; and FIG. 7 is a plan view of a prop for supporting the porous layer according to an alternative embodiment of the present invention.

Similar reference characters refer to similar parts throughout the various embodiments of the present invention.

DETAILED DESCRIPTION OF THE DRAWINGS

Figure 4:
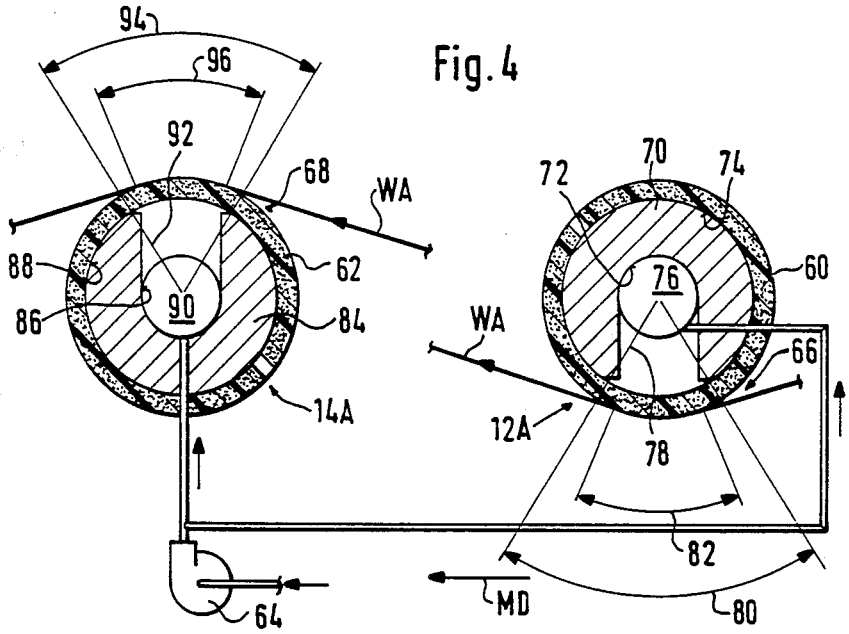
FIG. 4 is an enlarged sectional view of a first and second spreader bar shown in FIGS. 2 and 3.

FIG. 1 is a side-sectional view of a prior art spreader bar apparatus according to U.S. Pat. No. 4,176,775 to Dahl et al. The apparatus generally designated 10 includes a first and a second spreader bar 12 and 14 respectively having a web W partially enwrapping the first spreader bar 12 and then extending to and partially around the second spreader bar 14. Baffle bars 16, 17, 18 and 19 are secured to the respective spreader bars in order to reduce the generation of noise caused by a cushion of air flowing from the respective spreader bars through holes 20, 21, 22, 23 and 24, 25, 26, 27 respectively defined by the bars 12 and 14.

However, with the aforementioned prior art arrangement, the bars 12 and 14 are nonrotatable once the position of the baffle bars 16–19 have been fixed. Therefore, the prior art arrangement is not easily adjusted to handle various grades of paper.

The aforementioned problem is overcome by the spreader bar apparatus generally designated 10A according to the present invention as shown in FIG. 2. FIG. 2 is a perspective view from beneath the spreader bar apparatus 10A showing a first and a second spreader bar 12A and 14A respectively for separating slit portions 30, 31, 32, 33 and 34 of a web WA according to the present invention. The first spreader bar 12A extends in a cross-machine direction CD relative to the web WA. The first spreader bar 12A is bowed relative to the slit portions 30 to 34 such that the slit portions 30 to 34 are separated axially relative to each other when the slit portions 30 to 34 are guided around the first spreader bar 12A.

A second spreader bar 14A is disposed downstream relative to the first bar 12A and extends in the cross-machine direction CD relative to the web WA for guiding the separated slit portions 40, 41, 42, 43 and 44. The second spreader bar 14A is bowed relative to the separated slit portions 40 to 44 such that each of the slit portions 50, 51, 52, 53 and 54 disposed downstream relative to the second bar 14A are disposed parallel to each other.

FIG. 3 is an elevational view of the apparatus 10A and shows the web WA extending between the spreader bars 12A and 14A.

FIG. 4 is an enlarged sectional view of the spreader bar 12A and 14A and shows first and second porous layer 60 and 62 connected to the first and second bars 12A and 14A respectively such that when the bars 12A and 14A are connected to a source of pressurized air 64, air flows through the bars 12A and 14A and the porous layers 60 and 62 towards the slit portions 30 to 34 and 40 to 44 respectively for generating a first and second air cushion 66, 68 respectively. The air cushions 66 and 68 reduce the frictional resistance between the moving slit portions 30 to 34, 40 to 44 and the bars 12A and 14A respectively. The air cushions 66 and 68 also reduce the noise level caused by movement of the slit portions when the slit portions move relative to and are guided by the spreader bars 12A and 14A.

In one embodiment of the present invention as shown in FIGS. 2 to 4, the first spreader bar 12A includes a first tube 70 extending in the cross-machine direction CD relative to the web WA. The first tube 70 has an inner and an outer surface 72 and 74 respectively. The inner surface 72 defines a first conduit 76 which extends in the cross-machine direction CD. The first conduit 76 is connected to the source of pressurized air 64. The first tube 70 defines an elongate slot 78 which extends in the cross-machine direction CD and extends from the inner surface 72 to the outer surface 74.

The slot 78 has an angular width 80 in a machine direction MD which is greater than the wrap angle 82 of the slit portions 30 to 34 relative to the first porous layer 60.

The first porous layer 60 is secured to the first tube 70 such that the first porous layer 60 is disposed between the slit portions 30 to 34 and the slot 78 so that when the first conduit 76 is connected to the source of pressurized air 64, air flows through the first conduit 76 and the slot 78 and through the first porous layer 60 for generating the first air cushion 66 between the first porous layer 60 and the slit portions 30 to 34.

The second spreader bar 14A includes a second tube 84 extending in the cross-machine direction CD relative to the web WA. The second tube 84 has an inner face 86 and an outer face 88. The inner face 86 defines a second conduit 90 which extends in the cross-machine direction CD. The second conduit 90 is connected to the source of pressurized air 64 and the second tube 84 defines an elongate slit 92 which extends in the cross-machine direction CD and extends from the inner face 86 to the outer face 88.

The slit 92 has an angular width 94 in a machine direction MD which is greater than the wrap angle 96 of the slit portions 40 to 44 relative to the second porous layer 62.

The second porous layer 62 is secured to the second tube 84 such that the second porous layer 62 is disposed between the slit portions 40 to 44 and the elongate slit 92 so that when the second conduit 90 is connected to the source of pressurized air 64, air flow through the second conduit 90 and the slit 92 and through the second porous layer 62 for generating the second air cushion 68 between the second porous layer 62 and the slit portions 40 to 44.

FIG. 4 shows one embodiment of the present invention in which the first and second porous layers 60 and 62 respectively are tubular and extend around the outer surface 74 and outer face 88 of the first and second tubes 70 and 84 respectively.

Figure 5:
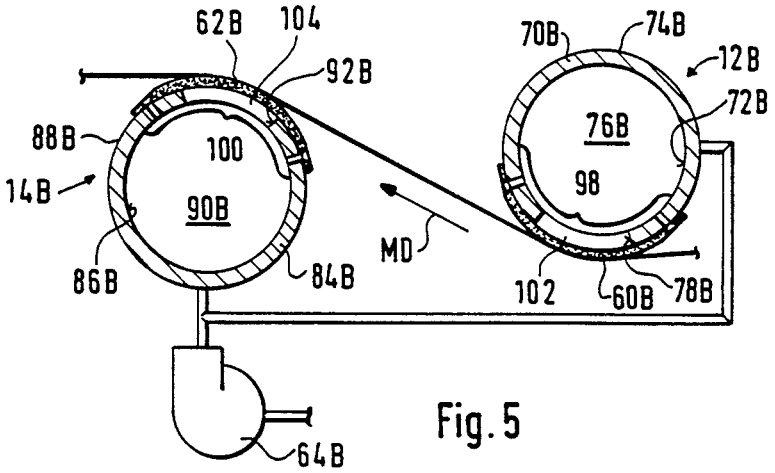
FIG. 5 is an enlarged sectional view of a first spreader bar according to a preferred embodiment of the present invention.

In a preferred embodiment of the present invention as shown in FIG. 5, the first and second porous layers 60B and 62B extend around a first and second portion 98 and 100 respectively of first and second bars 12B and 14B respectively so that the first layer 60B covers a slot 78B and the second layer 62B covers a slit 92B.

The slot 78B and the slit 92B house a first and second honeycomb support 102 and 104 respectively as shown in FIGS. 5 and 6. The supports 102 and 104 support the first and the second porous layers 60B and 62B respectively as shown in FIG. 5.

In an alternative embodiment of the present invention as shown in FIG. 7, the slot 78B and the slit 92B house respectively a first and a second prop 106 and 108 for supporting respectively the first and second layers 60B and 62B. The props 106 and 108 each define a plurality of holes.

The porous layers 60, 62 and 60B, 62B are fabricated from porous plastic and have a porosity within the range 20 to 100 microns.

The width of the slot 78 and the width of the slit 92 are such that these widths define respectively an arc of at least 63°.

The first and the second tubes in all the embodiments of the present invention are fabricated from a phenolic resin.

In operation of the apparatus according to the present invention, the slit web is guided around the spreader bars and pressurized air supplied through the spreader bars flows through the honeycomb supports and thereafter through the porous layers. Such air flow generates the air cushions between the porous layers and the slit portions. Due to the provision of a porous layers, the generation of a Coanda effect current is inhibited and the noise level is reduced by 14 percent compared with the prior art arrangement utilizing drilled holes.

The present invention provides a simple means for supporting the slit web on cushions of air without the attendant high noise factor associated with prior art devices. Furthermore, the present invention enables relative rotation of the respective spreader bars to accommodate various paper grades.

What is claimed is:

1. A spreader bar apparatus for separating slit portions of a web, said apparatus comprising:

a first spreader bar extending in a cross-machine direction relative to the web and bowed relative to the slit portions such that the slit portions are separated axially relative to each other when the slit portions are guided around said first spreader bar;

a second spreader bar disposed downstream relative to said first bar and extending in a cross-machine direction relative to the web for guiding the separated slit portions, said second spreader bar being bowed relative to the separated slit portions such that each of the slit portions disposed downstream relative to said second bar is disposed parallel to each other;

a first and second porous layer connected to said first and second bars respectively such that when said bars are connected to a source of pressurized air, air flows through said bars and said porous layers towards the slit portions for generating respectively a first and second air cushion, said air cushions reducing the frictional resistance between the moving slit portions and said bars, said air cushions also reducing the noise level caused by movement of the slit portions when the slit portions move relative to and are guided by said spreader bars; and said porous layers having a porosity within the range 20–100 microns.

2. A spreader bar apparatus as set forth in claim 1 wherein said first spreader bar further includes:

a first tube extending in said cross-machine direction relative to the web, said first tube having an inner and an outer surface, said inner surface defining a first conduit which extends in said cross-machine direction, said first conduit being connected to the source of pressurized air, said first tube defining an elongate slot which extends in said cross-machine direction and extends from said inner to said outer surface;

said slot having a width in a machine direction which is greater than the wrap angle of the slit portions relative to said first porous layer;

said first porous layer being secured to said first tube such that said first porous layer is disposed between the slit portions and said slot so that when said first conduit is connected to the source of pressurized air, air flows through said first conduit and said slot and through said first porous layer for generating said first air cushion between said first porous layer and the slit portions;

said second spreader bar further including:

a second tube extending in said cross-machine direction relative to the web, said second tube having an inner and an outer face, said inner face defining a second conduit which extends in said cross-machine direction, said second conduit being connected to the source of pressurized air, said second tube defining an elongate slit which extends in said cross-machine direction and extends from said inner to said outer face;

said slit having a width in a machine direction which is greater than the wrap angle of the slit portions relative to the second porous layer;

said second porous layer being secured to said second tube such that said second porous layer is disposed between the slit portions and said elongate slit so that when said second conduit is connected to the source of pressurized air, air flows through said second conduit and said slit and through said second porous layer for generating said second air cushion between said second porous layer and the slit portions.

3. A spreader bar apparatus as set forth in claim 2 wherein said first and second porous layers are tubular and extend around said outer surface and face respectively of said first and second tubes.

4. A spreader bar apparatus as set forth in claim 2 wherein said first and second porous layers extend around a first and second portion respectively of said first and second bars respectively so that said first layer covers said slot and said second layer covers said slit.

5. A spreader bar apparatus as set forth in claim 4 wherein said slot and said slit house a first and second honeycomb support respectively said supports supporting said first and second porous layers respectively.

6. A spreader bar apparatus as set forth in claim 4 wherein said slot and said slit house respectively a first and a second prop for supporting respectively said first and second layers, said props each defining a plurality of holes.

7. A spreader bar apparatus as set forth in claim 1 wherein said porous layers are fabricated from porous plastic.

8. A spreader bar apparatus as set forth in claim 2 wherein the width of said slot and said slit respectively are such that each width defines an arc of at least 63°.

9. A spreader bar apparatus as set forth in claim 2 wherein said first and second tubes are fabricated from a phenolic resin.

* * * * *